US005222884A

United States Patent [19]

Kapadia

[11] Patent Number: 5,222,884

[45] Date of Patent: Jun. 29, 1993

[54] NOISE LIMITERS FOR ROLLING PISTON COMPRESSOR AND METHOD

[75] Inventor: Neville D. Kapadia, Davidson, N.C.

[73] Assignee: Ingersoll-Rand Company, Woodcliff Lake, N.J.

[21] Appl. No.: 885,786

[22] Filed: May 20, 1992

[51] Int. Cl.[5] ..... F04C 18/356

[52] U.S. Cl. ..... 418/63; 418/150

[58] Field of Search ..... 418/63, 64, 65, 66, 418/67, 150

[56] References Cited

U.S. PATENT DOCUMENTS 4,664,608 5/1987 Adams et al. ..... 418/63

4,737,088 4/1988 Taniguchi et al. ..... 418/63

FOREIGN PATENT DOCUMENTS 913803 9/1946 France ..... 418/63

1-138393 5/1989 Japan ..... 418/63

*Primary Examiner*—Richard E. Gluck

*Attorney, Agent, or Firm*—Glenn B. Foster; Victor M. Genco, Jr.

[57] ABSTRACT

A rolling piston compressor includes substantially cylindrical casing having a variable diameter inner circumferential surface. A radially extending vane recess is formed in the casing. A first lateral surface is defined as a portion of the inner circumferential surface disposed immediately laterally of the vane recess on a first side. A second lateral surface is defined as a portion of the inner circumferential surface disposed immediately laterally of the vane recess on a second side, the second side being opposite to the first side. The first and second lateral surfaces are radially offset relative to each other. A rolling piston is mounted for rotational travel about the inner circumferential surface. A longitudinal contact line is defined between the first and second lateral surfaces across the vane recess. An impact reducer limits the severity of impact between the rolling piston and the second lateral surface during travel of the piston along the contact line. A resilient material may be used to form a resilient surface on the second lateral surface portion of the inner circumferential surface.

13 Claims, 3 Drawing Sheets

NOISE LIMITERS FOR ROLLING PISTON COMPRESSOR AND METHOD

BACKGROUND OF THE INVENTION

In rolling piston compressors, often, a guide vane, which is disposed within a vane recess formed in a cylindrical casing, is configured to limit passage of a working fluid between a high pressure port and a low pressure port. It may be advantageous in rolling piston designs to bias the rolling piston toward an inner circumferential periphery of the casing. As the rolling piston of these designs traverses these vane recesses, or other interruptions from a completely cylindrical internal surface formed in the casing, it frequently contacts the portion of the circumferential periphery which is disposed adjacent the vane recess, or a portion of the casing defining the vane recess.

The above described contact has a tendency to cause considerable noise, to reduce the efficiency of the rolling piston compressor operations due to the irregular path of the rolling piston with the casing as it makes this abutment, to generate excessive heat, and to cause vibration to (and fatigue of) the rolling piston compressor components.

The foregoing illustrates limitations known to exist in present rolling piston designs Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus including a substantially cylindrical casing having a variable diameter inner circumferential surface. A radially extending vane recess is formed in the casing. A first lateral surface is defined as a portion of the inner circumferential surface disposed immediately laterally of the vane recess on a first side. A second lateral surface is defined as a portion of the inner circumferential surface disposed immediately laterally of the vane recess on a second side, the second side is opposite to the first side. The first and second lateral surfaces are radially offset relative to each other.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
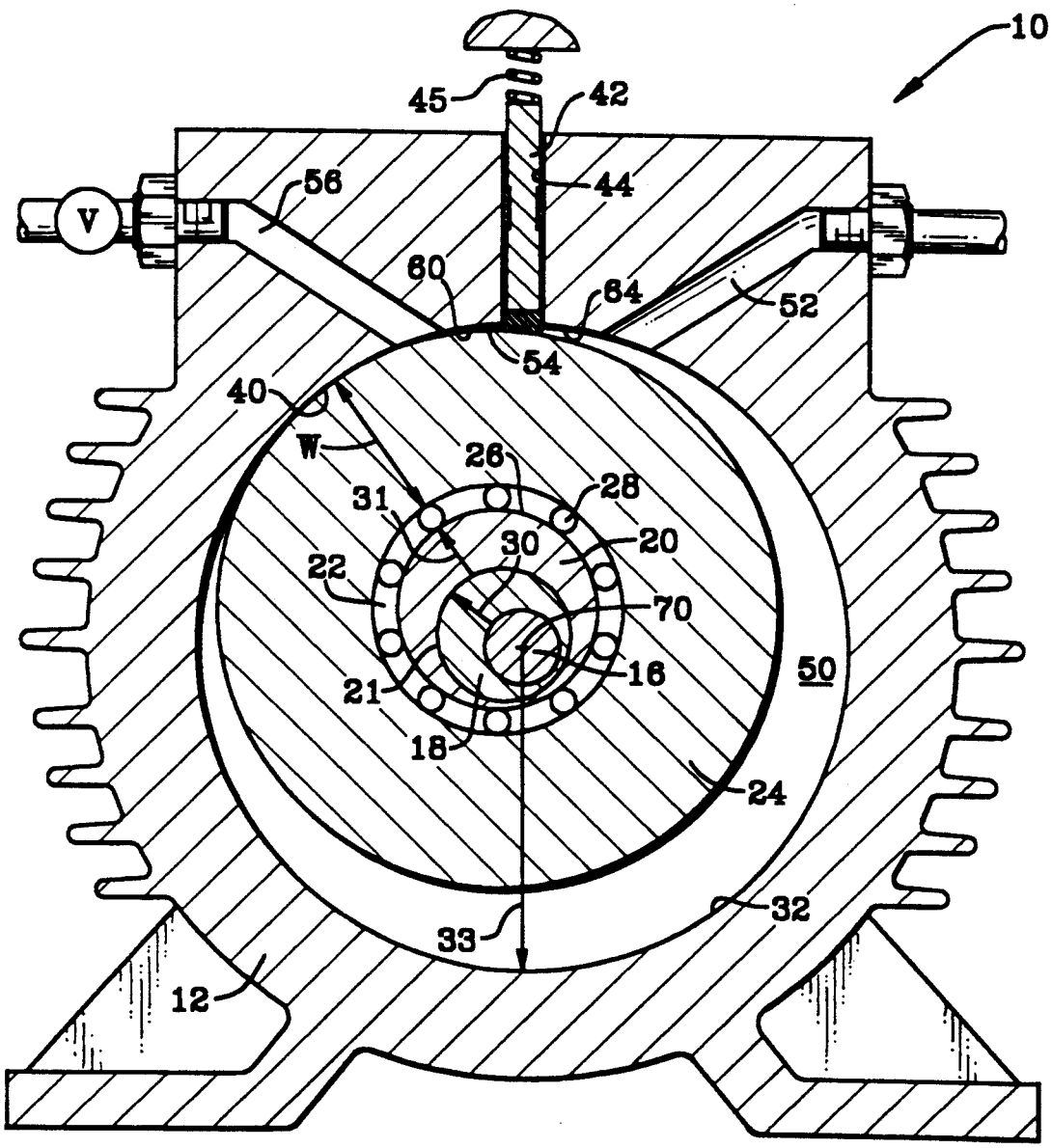
FIG. 1 (PRIOR ART)
FIG. 1 is a cross sectional view illustrating an embodiment of a prior art rolling piston compressor.

FIG. 1 illustrates a prior art rolling piston compressor 10 of the twin opposed eccentric configuration. In this specification, the term "compressor" is intended to cover pumps, compressors and any devices utilized to transfer fluids. The rolling piston compressor includes a substantially cylindrical casing 12 with a rolling piston 24 rotatably mounted therein. The rolling piston 24 is rotatably mounted on a shaft 16. An inner eccentric 18 is fixed relative to the shaft 16. An outer eccentric 20 is mounted about the inner eccentric by a journal bearing 21 in such a manner that relative rotational displacement is permitted between the inner eccentric and the outer eccentric. This type of rolling piston compressor is illustrated in application Ser. No. PCT/US91/09074, filed 12/14/91. A casing noise reduction system as described herein may be applied to the system as illustrated in the above mentioned patent application, or it may be applied to virtually an other type of rotary casing compressor, pump or motor known in the art, such as Wankel engines.

A substantially cylindrical rolling piston 24 is rotatably mounted about an outer periphery 26 of the outer eccentric 20 by a plurality of bearings 28. The outer periphery 26 and the rolling piston 24 are configured to receive the bearings 28 arranged in a bearing layer 22 in a manner well known in the art.

The inner eccentric 18 has a greatest inner eccentricity 30 while the outer eccentric 20 has a greatest outer eccentricity 31 defined within the rolling piston 24 being rotatably mounted within the substantially cylindrical casing 12. The substantially cylindrical casing 12 has an inner circumferential surface 32. A sum of radial distances of the greatest outer eccentricity 31, the greatest inner eccentricity 30, a width W of the rolling piston and a thickness of the bearing 28 is less than an inner radius 33 at any location about the inner circumferential surface 32 from an axis 70 (excluding a vane recess as described below).

As the rolling piston 24 rotates within the cylindrical casing 12, the combined effects of working fluid pressure applied to the rolling piston 24, and friction between the rolling piston 24 and the cylindrical casing, results in the greatest outer eccentricity 31 being rotationally biased so as to be coincident with the greatest inner eccentricity 30, but an actual state of coincidency will never occur due to the above described dimensional limitations. This configuration biases the rolling piston 24 into tangential contact with the inner circumferential surface 32 when the rolling piston compressor 10 is in normal operation. A contact line 40 is defined as the instantaneous line of contact between the rolling piston 24 and the cylindrical casing 12 (and in those portions where there is a recess in the regular contour of the inner circumferential surface, this contact line is a line defining the instantaneous most remote portion of the rolling piston from the axis 70). In normal operation, the contact line 40 follows the inner circumferential surface in a substantially synchronous motion relative to the inner eccentric 18 about the shaft 16.

A vane 42 extends substantially radially through a vane recess 44 defined within the cylindrical casing 12. A spring 45 biases the vane 42 into contact with the rolling piston 24. During operation, the vane 42 partially defines an inlet pressure region 50 (which is in fluid communication with an inlet port 52) and an outlet pressure region 54 (which is in fluid communication with outlet port 56) in a manner known in the art.

A first lateral surface 60 is defined as an inner axially extending portion of the inner circumferential surface 32 which is closely adjacent a first side of the vane recess 44. A second lateral surface 64 is defined as an axially extending portion of the inner circumferential surface 32 which is closely adjacent a second side of the vane recess. The first and the second sides are on opposed lateral sides of the vane recess.

Figure 2:
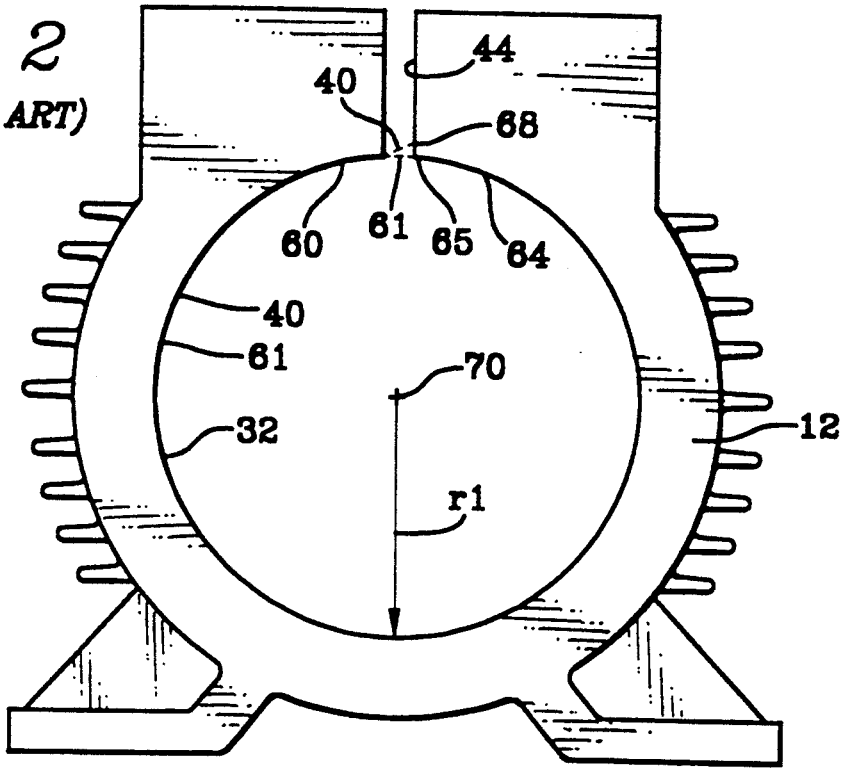
FIG. 2 (PRIOR ART)
FIG. 2 is a view of a casing illustrated in FIG. 1.

As the contact line traverses from the first lateral surface 60 to the second lateral surface 64, the action of centrifugal force along with the biasing forces of the inner eccentric 30 and the outer eccentric 31 combine to produce a trajectory of the contact line 40 as illustrated in FIG. 2 (described below). A normal contour 61 of the inner circumferential surface, as applied to all the figures, is illustrated and is defined as either the inner circumferential surface itself, or (where the vane recess interrupts the inner circumferential surface) a path drawn between the first lateral surface 60 and the second lateral surface 64 over the vane recess which follows the smoothest profile curve.

As the contact line 40 of the rolling piston traverses the vane recess 44 in FIGS. 1 and 2, the trajectory of the contact line 40 is directed towards an impact point 68, which is typically a portion of the casing defining the vane recess 44 and not a portion of the second lateral surface 64. This outward deflection of the rolling piston results in an impact between the rolling piston 24 and an edge 65 of the second lateral surface 64. This contact requires a considerable deflection of travel of the rolling piston (in prior art rolling piston configurations) resulting in noise, heat, deformation of the rolling piston 24 and the casing 12, fatigue of the associated elements and vibration of the entire rolling piston compressor 10, and disrupted sealing of the rolling piston and the associated elements.

Other prior art rolling piston configurations exert a tangential bias of the rolling piston 24 into contact with the inner circumferential surface. This problem is most pronounced in the twin eccentric rolling piston compressor configuration as illustrated in FIG. 1. The improvements illustrated in FIGS. 3, 4 and 5 can be utilized in the other rolling piston, or other similar cylindrical compressor, pump, or motor configurations as well as the twin eccentric rolling piston configuration.

Figure 3:
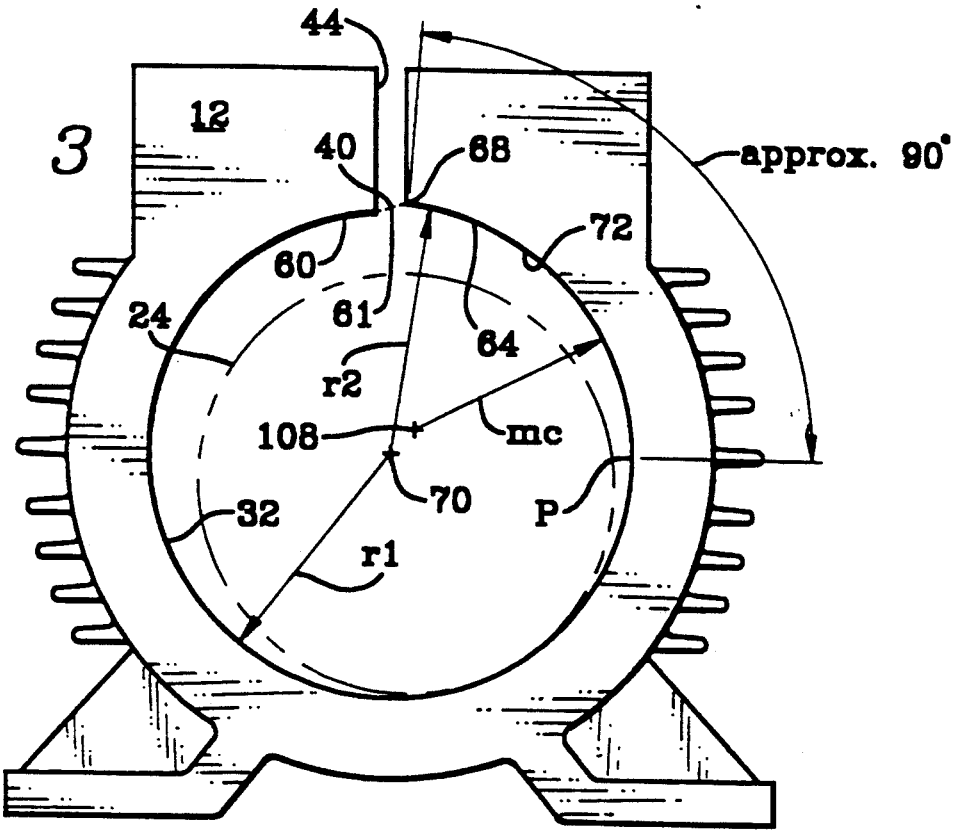
FIG. 3 is a view illustrating an embodiment of the casing portion of a rolling piston compressor of the present invention.

The present invention relates to an re device for limiting the severity of impact between the rolling piston 24 and the second lateral surface 64 during travel of the contact line from the first lateral surface 60 to the second lateral surface 64 across the vane recess 44. FIG. 3 illustrates a first embodiment of a rolling piston compressor impact reducing means of the present invention. In this embodiment, at least a portion of the second lateral surface 64 adjacent the vane recess 44 is provided with a radius r2 from the centroidal axis 70 of the substantially cylindrical casing 12 which is greater than a radius r1 which is applied to most of the remainder of the cylindrical casing 12.

Figure 5:
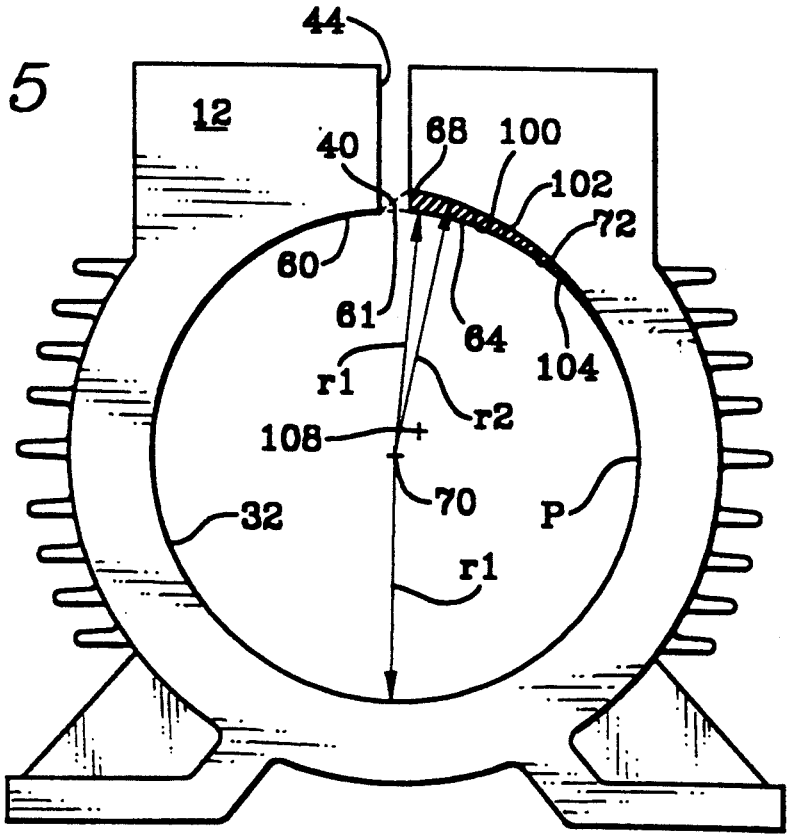
FIG. 5 is a view illustrating a further embodiment of the casing portion of a rolling piston compressor of the present invention.

It is preferable that the variable diameter inner surface 32 of FIGS. 3 and 5 is defined by a ramped portion 72 to merge the radial distances r2, r1 at a point P on the a.. inner surface 32 and provide a smooth transition of the contact line 40 back to the primary radius r1. Extending the ramped portion for approximately ninety degrees, as illustrated in FIG. 3, about the periphery of the casing provides a smooth merging of the roller piston, after it has crossed the vane recess and been displaced to the greater radius r2 from the axis 70, back to the a primary radius r1. The smoother the transition of the roller piston from the primary radius r1 to the greater radius r2, after traversing the slot, the less noise will be produced and the smaller the vibrational effects will be (along with other improvements over the prior art as described above). In a present system, the following sample equations indicate dimensional application of the FIG. 3 impact reducing device:

Rotational Speed of Shaft = 3000 RPM

Outer Radius of Piston ($r$) = 80 mm

Angular Velocity of Piston ($w$) = ($2 \times Pi \times N$)/ 60 = 314.15 Rad/Sec Angular Acceleration (Alpha) = $r$ x $w$(squared) = 7895 M/Sec Tangential Acceleration ($a$) = $r$ x Alpha = 631.6 M/(Sec)squared Total Acceleration (TotA) = squareroot (a squared + Alpha squared) = 7920 M/(Sec) Squared Included Angle made by 6.5 mm vane slot = 4.6 degrees Time Interval For Piston to Traverse Slot ($t$) = (60/3000) × (4.64/360 ) 2.57 × E-4

Distance Piston Moves in Radial Direction ($D$) = 0.5 × $a$ x $t$(squared) = 0.26 MM Therefore, to design a casing of the FIG. 3 rolling piston configuration, using the above example design criterion, the radius difference between r1 and r2 should equal or exceed 0.26 mm, which exceeds radial flyout of the rolling piston as it traverses the vane slot. The slot dwell angle is chosen to be 4.6 degrees. This ramp configuration permits a gradual return of the rolling piston compressor to the primary radius r1 within a segment defined as approximately 90 degrees of rolling piston travel which the ramp extends. The segment can be configured to a different dimension than 90 degrees, but this ninety degree dimension is a good rule of thumb which provides effective results.

Figure 4:
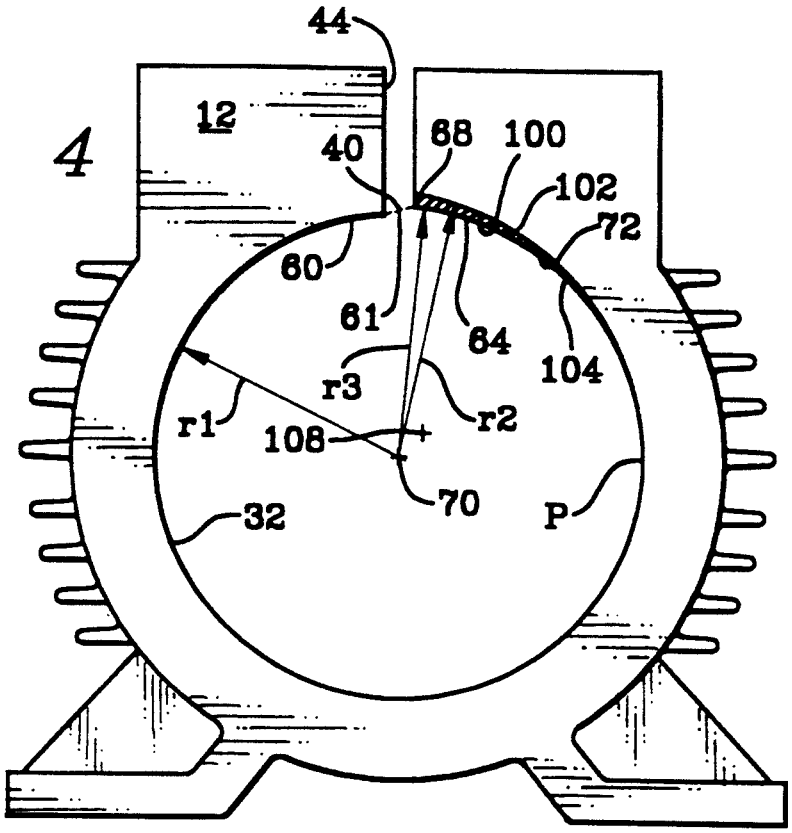
FIG. 4 is a view illustrating another embodiment of the casing portion of a rolling piston compressor of the present invention.

FIGS. 4 and 5 illustrate an alternate embodiment of the present invention which in many ways is similar to the FIG. 3 embodiment. In FIG. 4, a recess 100 is formed in the outer casing. This recess has a similar configuration to the ramped portion 72 but is preferably somewhat deeper. A resilient material layer 102 having a resilient surface 104 at a distance r3 from axis 70 (r3 being greater than r1 and less than r2) is formed on top of, or attached to, the upper circumferential portion of the recess 100 which forms the greater radius r2 portion. In the FIG. 4 embodiment, resilient surface 104 of the resilient material layer 102 is of a similar contour, for a rolling piston compressor having similar dimensions and operating parameters, as the ramped portion 72. This configuration provides another advantage of the resilient material acting as a replaceable insert (being at a location which receives much impact and wear during normal operation of the rolling piston compressor) can be easily replaced by techniques well known in the art, thereby prolonging the useable life of the casing 12.

In the FIG. 5 embodiment, the resilient surface 104 of the resilient material layer 102 is of approximately the same dimension as r1. The FIG. 5 embodiment does not account for large radial travel of the roller piston (as with the FIG. 3 embodiment) but is more suited to those types of rolling piston mounts in which the contact line 40 is not permitted to be specifically displaced a considerable radial distance from the primary radius r1 of the inner circumferential surface 32.

Materials which are suitable for use in the resilient member layer 102 include certain types of hard rubber and plastics. The selection of materials is largely based on the size of the rolling piston compressor, the associated loads, the angular velocity of typical operation and the number of hours which the specific rolling piston compressor is being designed to last. The deformation and durability of the resilient material is a key consideration of utilization of certain rubbers and plastics in this application.

In order to form a casing 12 including an inner circumferential surface having a varying inner diameter as illustrated in FIGS. 3, 4 and 5, the following techniques are used. Considering the FIG. 3 configuration, the primary radius r1 of the inner circumferential surface 32 is formed using a radial milling or broaching machine (or any other similar machining device well known in the art) Initially, the primary radius r1 is machined into the substantially cylindrical casing 12 having a first axis 70. Then, using a similar machining device and techniques, the greater radius r2 portion is formed in the second lateral surface 64 of the cylindrical casing 12 (machining about a second axis 108 utilizing a machine cut radius mc). The second axis 108 is located closer to the second lateral surface 64 than the first axis 70. This machining technique produces a total inner circumferential surface having a greater radius r2/primary radius r1 configuration capable of producing the merging effect to return the rolling piston compressor to its primary radius r1 smoothly, and with reduced noise and energy loss, after the rolling piston has traversed the vane recess 44. In numerical control machining processes, both cuts may be accomplished simultaneously as is known in the art.

While this invention has been illustrated and described in accordance with a preferred embodiment, it is recognized that other variations and changes may be made therein without departing from the invention as set forth in the claims.

Having thus described, what is claimed is:

1. An apparatus comprising:

a casing having an inner circumferential surface and a centroidal axis, the casing including a radially extending vane recess formed therein;

a first lateral surface forming a portion of the inner circumferential surface, the first lateral surface defining a constant distance r1 from the axis, the first lateral surface extending from a point P on the inner circumferential surface to a location immediately laterally of the vane recess on a first side; and a second lateral surface forming a portion of the inner circumferential surface, the second lateral surface defining a variable distance r2 from a location immediately laterally of the vane recess on a second side to the point P, the distance r2 being greater than r1 throughout a predetermined distance on the inner circumferential surface until the point P at which r2 equals r1.

2. The apparatus of claim 1 wherein the casing is a housing for a rolling piston.

3. The apparatus of claim 1 further including:

a resilient material forming a resilient surface on the portion of the inner circumferential surface defined as the second lateral surface.

4. The apparatus of claim 3 wherein the resilient surface is at the distance r1, from the axis.

5. The apparatus of claim 3 wherein the resilient surface is at a distance r3 from the axis, the distance r3 being greater that r1 and less than r2.

6. The apparatus of claim 5 wherein the distances r1, r3 merge at a point P on the inner circumferential surface.

7. An apparatus comprising:

a casing having an inner circumferential surface and a centroidal axis, the casing including a radially extending vane recess formed therein;

a first lateral surface forming a portion of the inner circumferential surface, the first lateral surface defining a constant distance r1 from the axis, the first lateral surface extending from a point P on the inner circumferential surface to a location immediately laterally of the vane recess on a first side;

a second lateral surface forming a portion of the inner circumferential surface, the second lateral surface disposed immediately laterally of the vane recess on a second side, the second side being opposite to the first side;

piston means rotatably mounted in the casing for rolling contact with the inner circumferential surface; and impact reducing means for limiting the severity of impact between the piston means and the second lateral surface during rotation of the rolling piston along a contact line from the first lateral surface to the second lateral surface across the vane recess, the impact reducing means defining a ramped portion on the second lateral surface.

8. The apparatus of claim 7 wherein the ramped portion of the impact reducing means defines a distance r2 from the axis, the distance r2 being greater than r1.

9. The apparatus of claim 8 further including:

a resilient material forming a resilient surface on the portion of the inner circumferential surface defined as the second lateral surface.

10. The apparatus of claim 9 wherein the resilient surface is at the distance r1 from the axis.

11. The apparatus of claim 9 wherein the resilient surface is at a distance r3 from the axis, the distance r3 being greater that r1 and less than r2.

12. The apparatus of claim 8 wherein the distance r1 equals r2 at a point P on the inner circumferential surface.

13. The apparatus of claim 11 wherein the distances r1, r3 merge at a point P on the inner circumferential surface.

* * * * *